US012042040B2

(12) United States Patent
Telthörster et al.

(10) Patent No.: US 12,042,040 B2
(45) Date of Patent: Jul. 23, 2024

(54) WARDROBE LIFT

(71) Applicant: Kesseböhmer Holding KG, Bad Essen (DE)

(72) Inventors: Dirk Telthörster, Bünde (DE); Andreas Redikop, Espelkamp (DE); Hermann Buschermöhle, Bersenbrück (DE)

(73) Assignee: Kesseböhmer Holding KG, Bad Essen (DE)

( * ) Notice: Subject to any disclaimer, the term of this patent is extended or adjusted under 35 U.S.C. 154(b) by 86 days.

(21) Appl. No.: 17/914,325

(22) PCT Filed: Feb. 25, 2021

(86) PCT No.: PCT/EP2021/054631
§ 371 (c)(1),
(2) Date: Sep. 24, 2022

(87) PCT Pub. No.: WO2021/190850
PCT Pub. Date: Sep. 30, 2021

(65) Prior Publication Data

US 2023/0104539 A1 Apr. 6, 2023

(30) Foreign Application Priority Data

Mar. 27, 2020 (DE) ..... 20 2020 101 657.1

(51) Int. Cl.
*A47B 61/00* (2006.01)
*A47B 46/00* (2006.01)
(Continued)

(52) U.S. Cl.
CPC ..... *A47B 61/003* (2013.01); *A47B 46/005* (2013.01); *A47F 7/19* (2013.01); *A47G 25/06* (2013.01); *A47F 7/24* (2013.01)

(58) Field of Classification Search
CPC ..... A47B 61/003; A47B 61/00; A47B 46/005; A47G 25/06; A47G 25/08; A47G 25/0685;
(Continued)

(56) References Cited

U.S. PATENT DOCUMENTS 1,836,008 A * 12/1931 Anzalone ..... D06F 57/12 212/336
2,433,275 A * 12/1947 Higby, Sr. ..... A47G 25/0685 211/104
(Continued)

FOREIGN PATENT DOCUMENTS

| | | |
|---|---|---|
| DE | 87 07 243.2 | 8/1987 |
| GB | 2 220 136 | 1/1990 |
| JP | H02164313 | 6/1990 |

*Primary Examiner* — Devin K Barnett
(74) *Attorney, Agent, or Firm* — Gudrun E. Huckett

(57) ABSTRACT

The invention relates to a wardrobe lift (1) having a wardrobe bar (4) which can be connected by means of at least one end region to at least one pivot lever (2, 3) and which can be moved from a higher vertical storage position for example in a cupboard interior to a loading position which is vertically lower than the storage position, wherein an operating element (6), which is pivotable relative to the wardrobe bar (4), is connected to the wardrobe bar (4) to pivot the pivot lever (2, 3) and the wardrobe bar (4). The wardrobe bar (4) is provided with a driver stop (10) for the operating element (6), which limits the relative pivotability of the operating element (6) and via which the wardrobe bar (4) can be moved by the operating element (6) to the higher storage position and back.

14 Claims, 6 Drawing Sheets

(51) Int. Cl.
*A47F 7/19* (2006.01)
*A47G 25/06* (2006.01)
*A47F 7/24* (2006.01)

(58) Field of Classification Search
CPC .. A47G 25/746; A47G 25/0692; A47K 10/04; A47K 10/10; A47F 7/19; A47F 7/24
See application file for complete search history.

(56) References Cited

U.S. PATENT DOCUMENTS 2,736,438 A * 2/1956 Frey ..... D06F 57/12 211/104
2,778,705 A * 1/1957 Barker ..... D06F 57/12 312/313
2,875,903 A * 3/1959 Shourds ..... A47B 61/02 211/100
3,211,295 A * 10/1965 Weiss ..... A47G 25/0685 211/100
3,417,874 A * 12/1968 Bryant ..... A47G 25/0685 211/100
3,961,699 A * 6/1976 Hirsch ..... B65G 47/57 198/465.4
4,005,852 A * 2/1977 Schmitmeyer ..... B66D 1/54 212/278
4,114,764 A * 9/1978 Rich ..... A47F 7/26 211/171
4,252,242 A * 2/1981 Tudor ..... A47B 61/02 211/104
4,323,162 A * 4/1982 Steinhilber ..... A47G 25/0685 211/100
5,011,029 A * 4/1991 Sugasawara ..... A47B 61/003 211/104
5,019,126 A * 5/1991 Post ..... A47G 25/0685 211/100
5,249,858 A * 10/1993 Nusser ..... A47B 46/005 312/319.6
5,695,072 A * 12/1997 Terragni ..... A47G 25/0685 211/1.51
6,105,795 A * 8/2000 Terragni ..... A47G 25/02 211/171
7,874,437 B2 * 1/2011 Jones ..... A47B 61/003 211/85.3
9,055,813 B2 * 6/2015 Telthorster ..... A47B 51/00
10,111,543 B2 * 10/2018 Terragni ..... A47G 25/0685
10,779,668 B2 * 9/2020 Erickson ..... A47G 25/746
11,613,839 B2 * 3/2023 Bixby ..... D06F 39/14 223/69
2005/0087731 A1 * 4/2005 Scott ..... B66D 1/52 254/283
2009/0178984 A1 7/2009 Ouyang
2010/0140194 A1 * 6/2010 Krueger ..... A47B 61/00 211/1.57
2011/0315642 A1 * 12/2011 Gubbrud ..... D06F 57/125 29/428
2012/0312760 A1 * 12/2012 Larson ..... B62H 3/12 211/1.51
2013/0264300 A1 * 10/2013 Shaffer ..... A47F 5/0006 211/117
2014/0116968 A1 * 5/2014 Krohn ..... A47B 61/02 211/1.51

* cited by examiner

WARDROBE LIFT

BACKGROUND OF THE INVENTION

The invention relates to a wardrobe lift, comprising a wardrobe rail that can be connected by the end regions thereof to pivot levers, which rail can be transferred by means of the pivot levers from a higher storage position located for example inside a closet into a loading position which is at a lower height compared with the storage position, an operating element which can be pivoted relative to the wardrobe rail being connected to the wardrobe rail in order to pivot the pivot levers and the wardrobe rail.

A wardrobe lift of the aforementioned type is known from German utility model DE 87 07 243.2. This wardrobe lift is in the form of a wall-mounted carrier and can be pivoted between a storage position (non-usage position) and a loading position (usage position). In this case, the wardrobe rail is pivotally connected to a support strut which can be gripped by an operator in order to transfer the rail out of the storage position into the loading position and back.

Furthermore, wardrobe lifts are known which have a wardrobe rail consisting of two pipes that can be pushed one into the other and can each be fastened by the lateral end regions thereof to pivot levers. These pivot levers can be fastened inside a closet or to wall parts arranged at a distance from one another. A grab bar hanging downwards as an operating element surrounds the two-part wardrobe rail so as to be rotatable relative to the wardrobe rail. In this known wardrobe lift, it is disadvantageous that it is not possible to ensure any torsional rigidity or torsional stiffness between the pivot levers, and therefore the pivot levers pivot in a nonuniform manner. This is disadvantageous in particular when the wardrobe rail is loaded on one side by items of clothing hung up thereon, and/or when the operating element is positioned off-center. Furthermore, because the operating element is not user-friendly, it is difficult for an operator to control, since the operator has to push the wardrobe rail perpendicularly upward.

The problem addressed by the present invention is that of improving a wardrobe lift of the type mentioned at the outset with respect to the ease of use thereof while lifting and lowering the wardrobe lift in the loaded state.

SUMMARY OF THE INVENTION

In order to solve this problem, the invention proposes improving a wardrobe lift of the type mentioned at the outset in that the wardrobe rail is provided with a driver stop for the operating element, which defines the relative pivotability of the operating element and by means of which the wardrobe rail can be transferred from the operating element into the higher storage position and back.

A wardrobe lift is thus provided in which, by defining the relative rotatability and pivotability of the operating element with respect to the wardrobe rail, the operating element can be pivoted out of the non-usage position firstly into a position in which it is pivoted relative to the wardrobe rail as far as the driver stop, then is in contact with the driver stop, and a lever force is exerted on the wardrobe rail by the operator by means of the operating element, which force substantially simplifies the pivoting and thus the lifting of the wardrobe rail out of the loading position into the storage position, since, as a result of this lever force, the gravitational load forces can also be compensated. This results in greatly improved handling, in particular when lifting and thus when pivoting a loaded wardrobe rail by means of the introduction of torque and thus the reduction in the application of force by the operator. This driver stop also helps to better control the lowering when swinging down the wardrobe rail.

The operating element can preferably be transferred from a substantially vertically downward-hanging inoperative position into the operating position in which the element is in contact with the driver stop by means of a pivoting movement directed toward the user. In this position, the operator can exert a force on the wardrobe rail with a torque on the wardrobe rail together with the items of clothing hanging thereon, the force applied being reduced in comparison with conventional wardrobe rails, in order to bring the wardrobe rail into the higher storage position (inoperative position). The operating element is provided centrally on the wardrobe rail so that, by means of the lever force transferred directly to the driver stop by the operator, the forces can be transferred to the wardrobe rail in a uniform manner so that the pivot levers can pivot in a uniform manner.

The operating element is preferably designed in such a way that it includes a part for connecting to the wardrobe rail which encompasses the wardrobe rail at least in some regions and comprises a recess reaching as far as a stop face on the connecting part and as far as the outer periphery of the wardrobe rail. By means of this recess, the operating element can be pivoted and rotated relative to the wardrobe rail until an end of the recess comes into contact with the driver stop, after which a form fit and friction fit transmission of force can be carried out. The driver stop part can be designed with an L-shaped or U-shaped cross section and can be rigidly connected to the wardrobe rail. This part can thus be designed in such a way that the operating element is pivotally supported on this L-shaped or U-shaped driver part. However, the driver stop can also be formed by a screw that can be screwed into the wardrobe rail and has a screw head, the screw head being placed in the recess on the connecting part that reaches as far as the outer periphery of the wardrobe rail.

Each end of the wardrobe rail can be fastened to a pivot lever. Furthermore, however, it is also possible for the wardrobe rail to be connected on both sides to a four-bar linkage having two pivot levers in each case. For this purpose, an upper shelf pivoted together with the wardrobe rail can also be provided above the wardrobe rail. The wardrobe rail is connected in a friction fit and form fit manner to the corresponding pivot levers.

So that different closet widths or alcove widths can be taken into account, the wardrobe rail can be designed to be longitudinally adjustable. For this purpose, connecting elements which are connected to the pivot levers can be provided. For this purpose, a connecting element can comprise at least one slot (as one exemplary embodiment), preferably a plurality of slots, for longitudinally adjustable connection to the wardrobe rail. To have this covered for use, lateral sleeves can be placed over the adjustment region of the wardrobe rail.

For example rows of holes can also be provided for longitudinal adjustment. The slots can also be provided in the wardrobe rail.

The connecting elements can also be provided by U-shaped connecting profiles, for example also in such a way that the wardrobe rail has a flattened contact surface for the U-shaped connecting element in an end region thereof.

It is also possible for the connecting element to have a profile having a D-shaped cross section, and for the end region of the wardrobe rail to be correspondingly formed in a congruent D-shape in such a way that the connecting element can be introduced into the wardrobe rail.

Alternatively, the wardrobe rail can be in the form of a polygonal open profile into which a connecting element can be introduced from inside. In a cost-effective and easy-to-assemble manner, at least two lateral pivot levers can have bent branches to pivot the wardrobe rail, which branches form connecting elements to which the wardrobe rail can be connected.

BRIEF DESCRIPTION OF THE DRAWINGS

Further advantageous embodiments of the invention can be found in further dependent claims, the following description and the drawings, in which:

DESCRIPTION OF PREFERRED EMBODIMENTS

Figure 1:
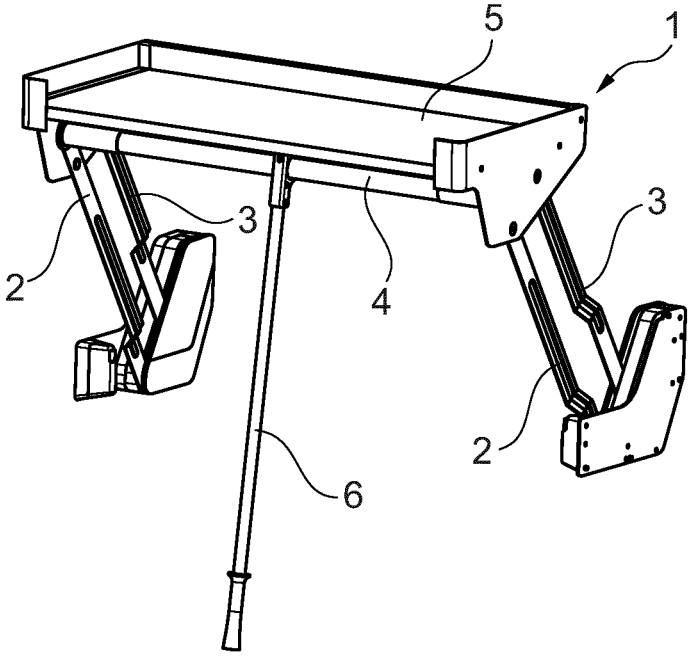
FIG. 1: is a perspective view of an exemplary embodiment of a wardrobe lift having two lateral four-bar linkages in each case.

In the drawings, like parts are provided with the same reference numerals.

In general, 1 denotes the wardrobe rail, which, in the exemplary embodiment according to FIG. 1, has two pivot levers 2 and 3 on each side, which form a four-bar linkage, the wardrobe rail 4 being fastened to the two pivot levers 2. An upper shelf 5 is also provided above the wardrobe rail, which shelf can also be pivoted together with the wardrobe rail 4 by the pivot levers 2 and 3. On the wardrobe rail 4, an operating element 6 engages, by means of which element, as will be described in greater detail in the following, the wardrobe rail 4 can be pivoted via the pivot levers 2 and 3 or, according to the exemplary embodiment from FIG. 2, via the two pivot levers 2.

Figure 2:
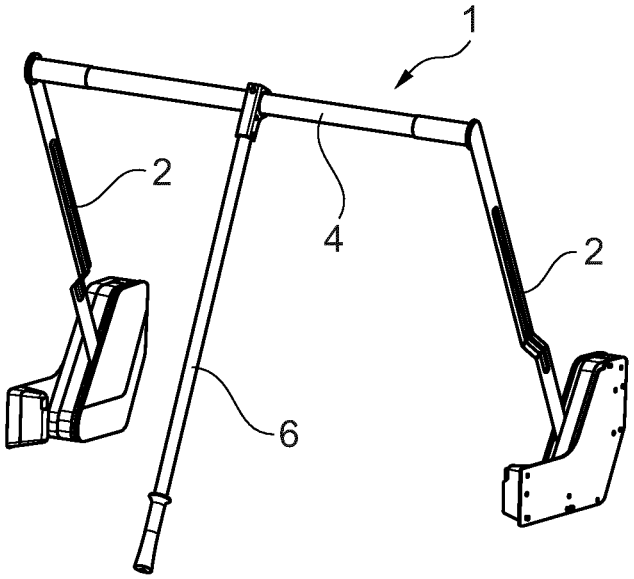
FIG. 2: shows an alternative exemplary embodiment of a wardrobe lift having two lateral pivot levers.
Figure 5:
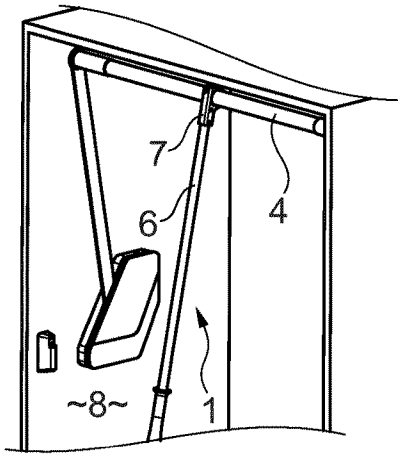
FIGS. 5 and 5*a*: are views analogous to FIGS. 3 and 4, and 3*a* and 4*a* respectively when the wardrobe rail reaches the storage position.
Figure 5A:
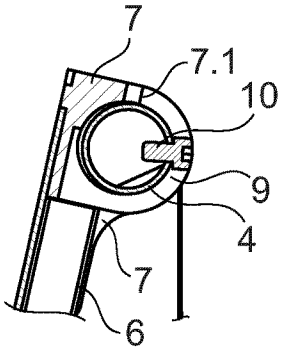
Figure 4:
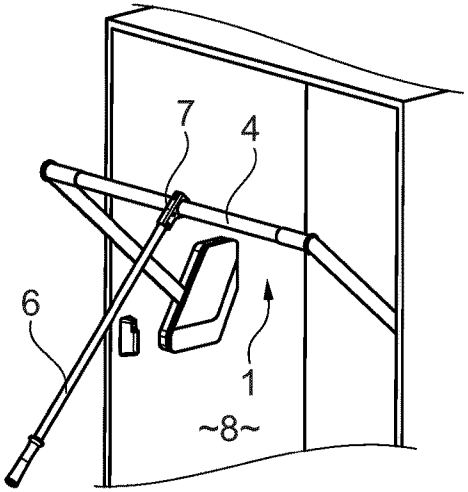
FIGS. 4 and 4*a*: are views analogous to FIGS. 3 and 3*a* in the course of the movement of the wardrobe rail out of the loading position into the storage position.
Figure 4A:
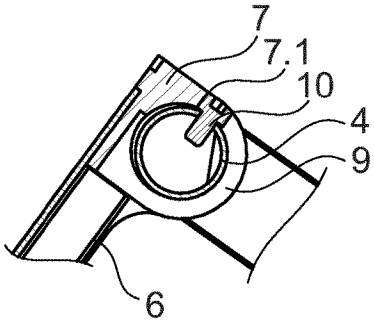
Figure 3A:
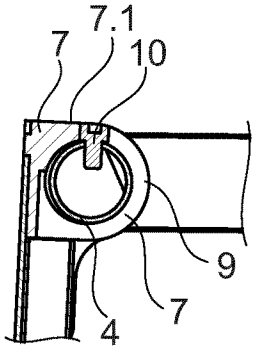
FIG. 3*a*: is a cross-sectional view through the operating element (in part) and the wardrobe rail in the region of the driver stop.
Figure 3:
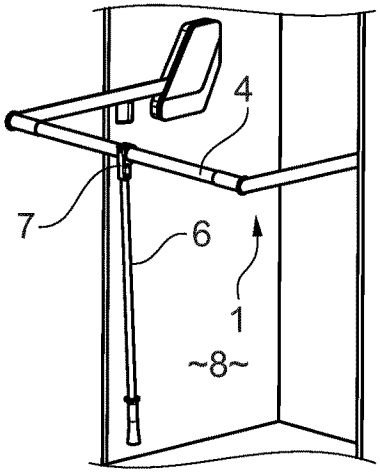
FIG. 3: shows the exemplary embodiment according to FIG. 2 in the loading position of the wardrobe rail with an exemplary embodiment of a driver stop.

In FIGS. 3, 3*a*, 4, 4*a*, 5 and 5*a*, the exemplary embodiment according to FIG. 2 is shown in various pivoted positions of the wardrobe rail 4, namely once in the loading position according to FIGS. 3 and 3*a* (operating position), in the intermediate position in the course of the wardrobe rail 4 being pivoted out of the loading position into the storage position (inoperative position) and in FIGS. 5 and 5*a* in the position of the wardrobe rail 4 in the storage position (inoperative position), wherein FIGS. 3*a*, 4*a* and 5*a* each show a cross section through the wardrobe rail 4 and the operating element 6, specifically with the connecting part 7 shown as a first exemplary embodiment.

In the various positions shown here, the wardrobe lift 1 is mounted in a closet 8. As can be seen more clearly from the drawings according to FIGS. 3*a*, 4*a* and 5*a*, the wardrobe rail 4 is surrounded by a connecting part 7, which acts on the wardrobe rail 4 in the central middle region and connects the operating element 6 to the wardrobe rail 4. This connecting part 7 has a central recess 9 which is delimited by two branches and in which a screw head of a screw 10 is placed. In FIGS. 3*a* and 4*a*, the screw head of this screw 10 is in contact with a stop face 7.1 of the connecting part 7. In this position, by means of the operating element 6 and the connecting part 7 with the stop face 7.1, a force can be exerted on the screw head of the screw 10. By means of this force, the wardrobe rail 4 can be levered upward into the storage position that can be seen in FIG. 5, so that the operating element 6 can then be pivoted in turn together with the connecting part 7 so that the screw head is placed in the recess 9, away from the stop face 7.1.

Figure 6:
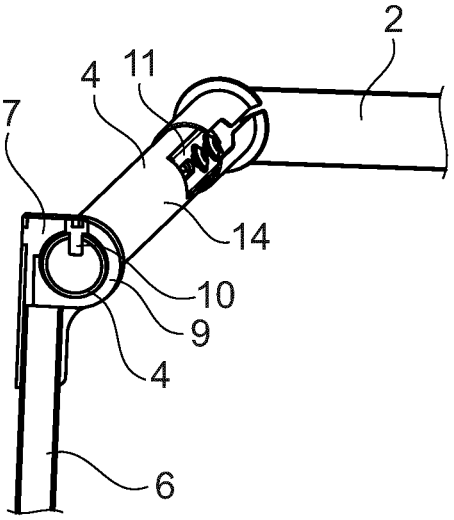
FIG. 6: is a partial sectional view and a perspective view of an exemplary embodiment of a wardrobe rail comprising elements for connecting to the pivot lever with slots and options for adjusting the length of the wardrobe rail.
Figure 7:
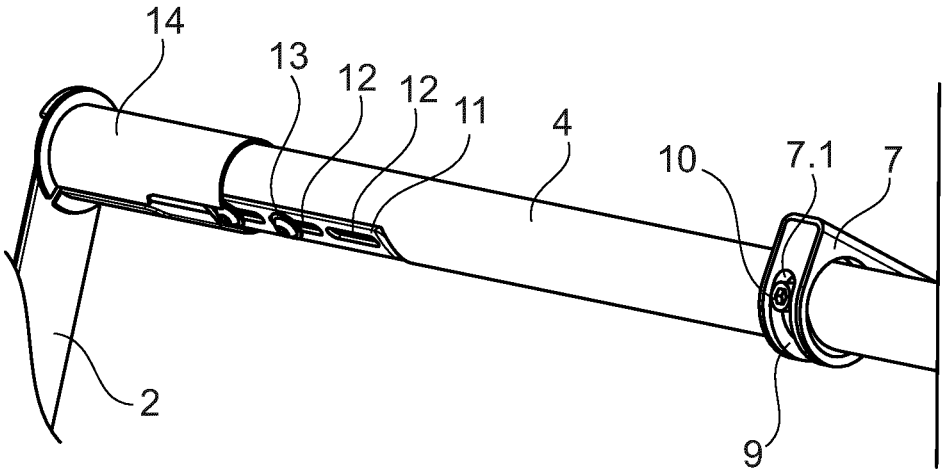
FIG. 7: is another perspective view of an exemplary embodiment according to FIG. 6.

In FIG. 6, in the central region of the connecting part 7 and the operating element 6, the component is shown in section in the region of the wardrobe rail. In this section, the screw 10, the connecting part 7 and the recess 9 are shown. A connecting element 11 comprising a plurality of slots 12 is shown therein. The wardrobe rail 4 can be fastened to the connecting element 11 in a longitudinally adjustable manner by means of a screw 13. A cover 14 can be placed over the end regions of the wardrobe rail 4.

Figure 8:
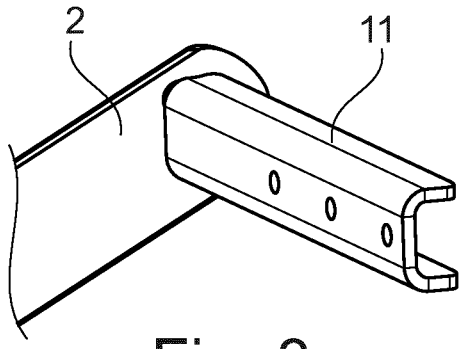
FIG. 8: is a perspective view of an exemplary embodiment of a connecting element for the wardrobe rail.
Figure 9:
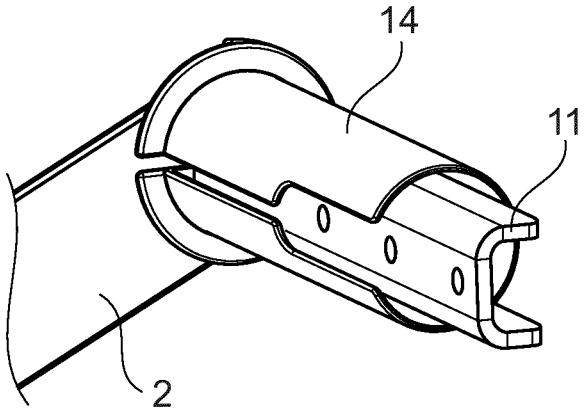
FIG. 9: is a perspective view of the exemplary embodiment according to FIG. 8 with lateral sleeves placed over.
Figure 10:
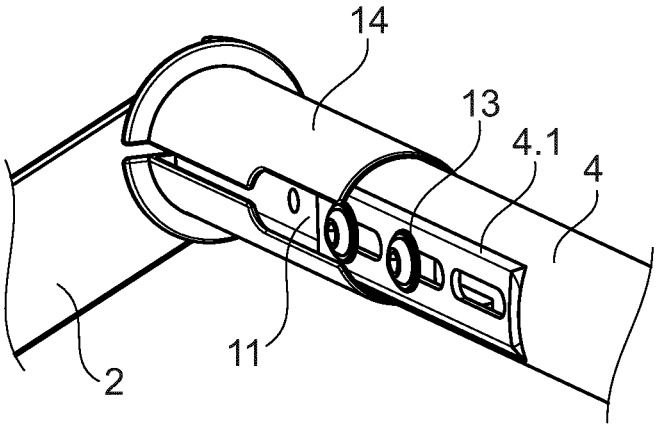
FIG. 10: is a perspective view of the exemplary embodiment according to FIG. 9 connected to the wardrobe rail.

FIGS. 8, 9 and 10 show an alternative design of a connecting element 11 which has a substantially U-shaped cross section and acts on the pivot lever 2. This connecting element is to be inserted into the tube of the wardrobe rail 4, on which a flat portion 4.1 is provided, having corresponding slots, so that it is also possible to adjust the length of the wardrobe rail, and the wardrobe rail 4 is to be screwed to the driver element 11 by means of screws 13. The end region can be covered by means of a cover.

Figure 11:
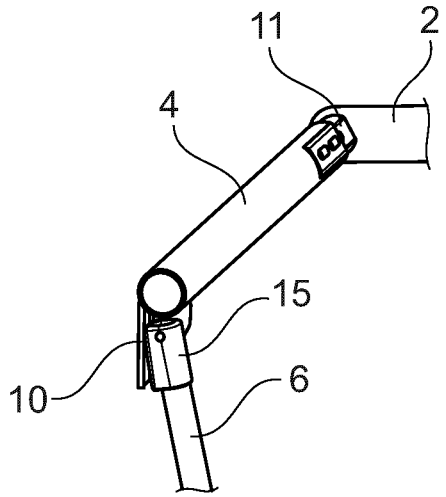
FIG. 11: is a perspective view of an alternative exemplary embodiment of a driver stop designed with an L-shaped cross section, in which the operating element is pivotally supported.
Figure 12:
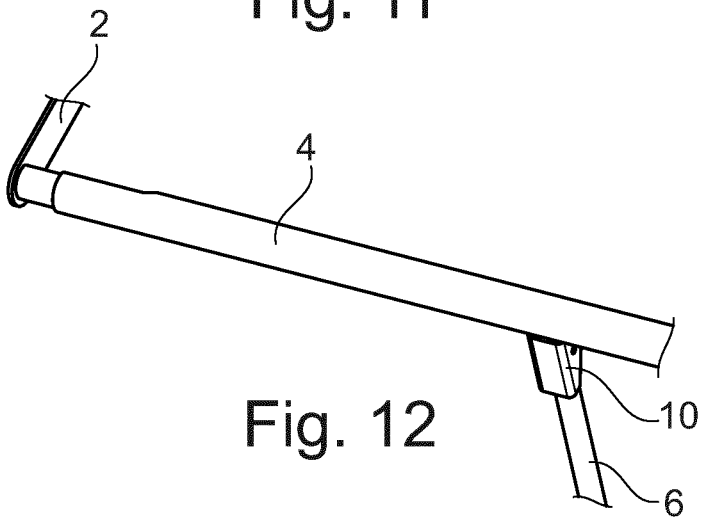
FIG. 12: is another perspective view of the exemplary embodiment according to FIG. 11.

FIGS. 11 and 12 show an alternative exemplary embodiment of a driver stop 10. In this exemplary embodiment, this driver stop 10 is in the form of an L-shaped profile and is rigidly connected to the wardrobe rail 4. The wardrobe rail 4 is pivotally attached to this driver stop 10 by means of the connecting element 15.

Figure 13:
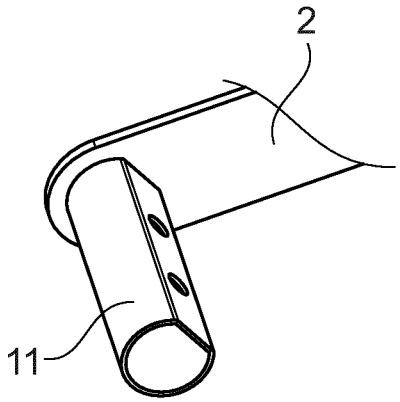
FIG. 13: is a perspective view of an alternative exemplary embodiment of a connecting element having a profile structure which has a D-shaped cross section.
Figure 14:
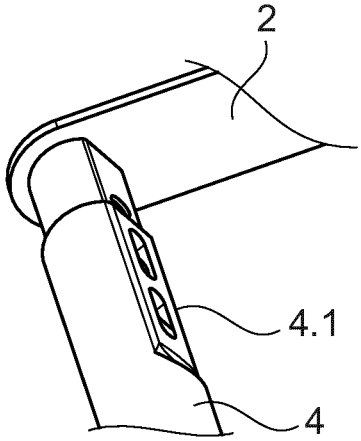
FIG. 14: shows an alternative exemplary embodiment of a wardrobe rail, which likewise has a D-shaped cross section, with a connecting element placed over.

FIG. 12 illustrates this design of the driver stop 10 once again. As shown in FIGS. 13 and 14, the ends are provided with a flat portion 4.1. This flat portion 4.1 makes the end of the wardrobe rail 4 D-shaped in cross section toward the end so that the connecting part 11 provided in this exemplary embodiment is likewise a D-shaped profile which is rigidly connected to the lever 2.

Figure 15:
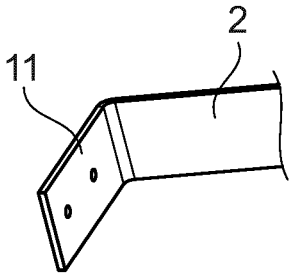
FIG. 15: is a perspective view of another alternative exemplary embodiment of a connecting element in the form of a bent pivot lever.
Figure 16:
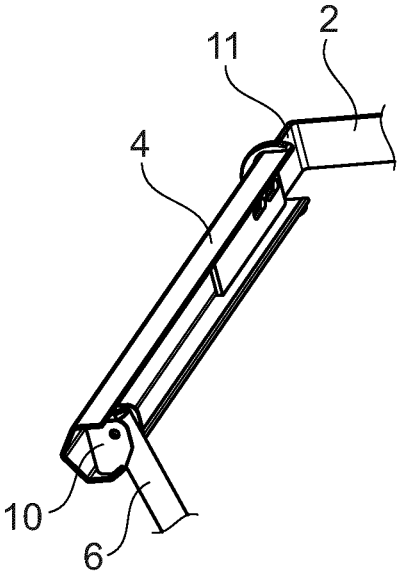
FIG. 16: shows an exemplary embodiment of a wardrobe rail bent multiple times, which is open toward the inside and into which the connecting element according to FIG. 15 can be inserted.
Figure 17:
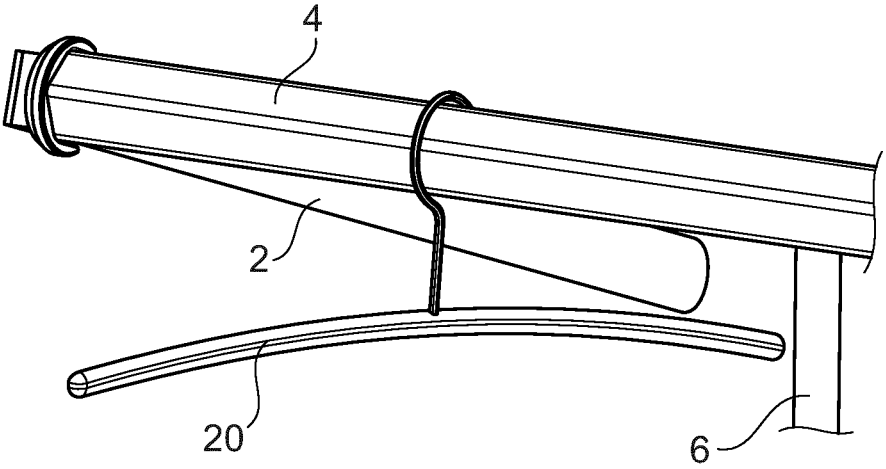
FIG. 17: is a perspective view of the polygonal open structure of the wardrobe rail according to FIG. 16 in a view from the user side.

In FIGS. 15 to 17, another alternative design of the connecting part 11 is shown, which in this exemplary embodiment is in the form of a bent branch (connecting part 11) of the pivot lever 2. The wardrobe rail 4 is in the form of a polygonal open profile into which the connecting element 11 can be inserted from inside, as shown in FIG. 16. The operating element 6 can also be provided inside the wardrobe rail 4 by means of the U-shaped driver stop 10 (FIG. 16).

FIG. 17 shows the view from the user side with a coat hanger 20 shown on the wardrobe rail 4 so that it is clear that the polygonal shape of the wardrobe rail 4 does not impair the functionality thereof. The round coat hanger hook is at a 90° angle to the angular wardrobe rail and rotates less when the wardrobe rail is pivoted upward. Items of clothing that are hung up thus collide with the sides of the closet body less often.

What is claimed is:

1. A wardrobe lift (1) comprising:

a wardrobe rail (4) comprising opposed end regions, the wardrobe rail (4) configured to be connected by at least one of the end regions to one or more pivot levers (2, 3), wherein the wardrobe rail (4) is configured to be transferred from a high storage position into a low loading position, wherein the low loading position is vertically lower than the high storage position;

an operating element (6) connected to the wardrobe rail (4) so as to pivot relative to the wardrobe rail (4), the operating element (6) configured to pivot the wardrobe rail (4) together with the one or more pivot levers (2, 3);

a driver stop (10) arranged on the wardrobe rail (4) and configured to interact with the operating element (6), wherein the driver stop (10) defines a relative pivotability of the operating element (6) relative to the wardrobe rail (4), and wherein the wardrobe rail (4) is configured to be transferred by the operating element (6) via the driver stop (10) into the high storage position and back;

wherein the opposed end regions of the wardrobe rail (4) are connected to a four-bar linkage, respectively, wherein the four-bar linkages each include two of the one or more pivot levers (2, 3), or the opposed end regions of the wardrobe rail (4) each are connected to a single one of the one or more pivot levers (2, 3);

wherein the opposed end regions of the wardrobe rail (4) each are connected in a form fit and friction fit manner to the two pivot levers of the four-bar linkages or to the single one of the one or more pivot levers.

2. The wardrobe lift (1) according to claim 1, wherein the operating element (6) is configured to be transferred by a pivoting movement directed toward a user from an inoperative position of the operating element (6), in which the operating element (6) points substantially vertically downwardly, into an operating position of the operating element (6), in which the operating element (6) is in contact with the driver stop (10).

3. The wardrobe lift (1) according to claim 1, wherein the operating element (6) is connected to the wardrobe rail (4) by a connecting part (7), wherein the connecting part (7) encompasses the wardrobe rail (4) at least in some regions and comprises a recess (9), wherein the recess (9) extends as far as a stop face (7.1) of the connecting part (7) and as far as an outer periphery of the wardrobe rail (4).

4. The wardrobe lift (1) according to claim 1, wherein the operating element (6) is pivotable relative to the driver stop (10) fastened to the wardrobe rail (4).

5. The wardrobe lift (1) according to claim 1, wherein the driver stop (10) is an L-shaped or U-shaped driver part, wherein the operating element (6) is pivotally supported on the L-shaped or U-shaped driver part.

6. The wardrobe lift (1) according to claim 1, further comprising connecting elements (11) which connect by a longitudinally adjustable connection the end regions of the wardrobe rail (4) to the two pivot levers of the four-bar linkages or to the single one of the one or more pivot levers, respectively.

7. The wardrobe lift (1) according to claim 6, wherein the connecting elements (11) or the wardrobe rail (4) has at least one slot (17) for realizing the longitudinally adjustable connection.

8. The wardrobe lift (1) according to claim 6, further comprising lateral sleeves, wherein the lateral sleeves cover a respective adjustment region of the longitudinally adjustable connection of the wardrobe rail (4) and the connecting elements (11).

9. The wardrobe lift (1) according to claim 6, wherein the connecting elements (11) are U-shaped connecting profiles.

10. The wardrobe lift (1) according to claim 9, wherein the end regions of the wardrobe rail (4) each have a flattened contact surface configured to contact the U-shaped connecting profiles.

11. The wardrobe lift (1) according to claim 6, wherein the connecting elements (11) have a profile with a D-shaped cross section, and wherein the end regions of the wardrobe rail (4) are correspondingly formed to have a D-shape congruent to the D-shaped cross section such that the connecting elements (11) are configured to be introduced into the wardrobe rail (4).

12. The wardrobe lift (1) according to claim 6, wherein the end regions of the wardrobe rail (4) have a polygonal open profile configured to have the connecting elements (11) inserted from inside.

13. The wardrobe lift (1) according to claim 12, wherein the connecting elements (11) are formed by bent branches of the pivot levers (2) connected to the end regions of the wardrobe rail (4).

14. The wardrobe lift (1) according to claim 1, wherein the driver stop (10) is a screw (10), comprising a screw head and configured to be screwed into the wardrobe rail (4), and/or is a plug-in bolt.

* * * * *